US011154444B1

(12) United States Patent
Yu

(10) Patent No.: US 11,154,444 B1
(45) Date of Patent: Oct. 26, 2021

(54) AUTOMATED ROLLING BED

(71) Applicant: Changkuan Yu, Miramar, FL (US)

(72) Inventor: Changkuan Yu, Miramar, FL (US)

( * ) Notice: Subject to any disclaimer, the term of this patent is extended or adjusted under 35 U.S.C. 154(b) by 0 days.

(21) Appl. No.: 17/326,627

(22) Filed: May 21, 2021

(51) Int. Cl.
*A61G 7/00* (2006.01)

(52) U.S. Cl.
CPC ..... *A61G 7/001* (2013.01)

(58) Field of Classification Search
CPC .. A61G 7/1017; A61G 7/1026; A61G 7/1032; A61G 7/1034; A61G 7/001; A61G 7/057; A47C 21/006
See application file for complete search history.

(56) References Cited

U.S. PATENT DOCUMENTS 5,544,371 A * 8/1996 Fuller ..... A61G 7/1015 5/85.1
7,895,688 B1 * 3/2011 Rowes ..... A61G 7/001 5/612
2007/0151025 A1 * 7/2007 Wei ..... A61G 7/1067 5/81.1 R
2008/0222811 A1 * 9/2008 Gilbert ..... A61G 13/04 5/607
2009/0307841 A1 * 12/2009 James ..... A61G 7/1015 5/88.1
2014/0317843 A1 * 10/2014 Martin ..... A61G 7/1046 5/87.1
2020/0315885 A1 * 10/2020 Connor ..... A61G 7/1055

* cited by examiner

*Primary Examiner* — David R Hare
*Assistant Examiner* — Adam C Ortiz
(74) *Attorney, Agent, or Firm* — Christopher J. VanDam, PA; Chris Van Dam

(57) ABSTRACT

A medical bed for automatically rolling a patient from back to either side to help avoid the pressure points causing decubitus ulcers. A footboard is provided with a pair of driving mechanisms to independently move a first carriage and a second carriage. The driving mechanisms each translate force to a corresponding unpowered third carriage and fourth carriage on the headboard. The first and third carriages are connected by a first roller shaft. The second and fourth carriages are also connected by a second roller shaft. The first roller shaft and second roller shaft are connected to opposing parallel edges of a sheet. The first and second roller shaft each independently spool the edges of the sheet. As the first roller shaft spools the sheet and the first and third carriages move carrying the first roller shaft, the patient is rolled in a first direction. Independently, the second roller shaft spools the opposing edge of the sheet and the second and fourth carriages move the second roller shaft to roll the patient in a second direction. A middle position leaves the patient on their back.

3 Claims, 8 Drawing Sheets

AUTOMATED ROLLING BED

STATEMENT REGARDING PRIOR DISCLOSURES BY AN INVENTOR OR JOINT INVENTOR

None.

BACKGROUND OF THE INVENTION

1. Field of the Invention

The present invention relates to convalescent beds, and more particularly, to an improved device and method of use to automatically roll a patent from back to either side to relieve pressure that causes decubitus ulcers.

2. Description of Related Art Including Information Disclosed Under 37 CFR 1.97 and 37 CFR 1.98

Several designs for repositioning beds have been designed in the past. None of them, however, includes a pair of parallel roller shafts that move independently and spool a connected sheet to gently and automatically roll a patient lying on the sheet from side to back to the other side to reduce the risk of decubitus ulcers, also known as pressure ulcers or bed sores.

Applicant believes that the closest reference corresponds to U.S. Pat. No. 5,659,905 issued to Palmer. However, it differs from the present invention because the Palmer device requires a proprietary bed frame that includes arms that roll and drag the patient to completely roll them from back to face. The arms increase the width of the bed and prevent it from being placed close to walls or other adjacent structure. The face down position is also uncomfortable.

In contrast, the present device may be affixed to any size bed frame by replacing the headboard and footboard with the disclosed novel structure. The present invention can be placed of directly adjacent to a wall without interfering with that structure. The present design does not roll the patient onto an uncomfortable face down position.

Other patents describing the closest subject matter provide for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

BRIEF SUMMARY OF THE INVENTION

It is one of the main objects of the present invention to provide a medical bed that automatically rolls a bedridden patient from left side, to back and to right side to avoid pressure points that may cause decubitus ulcers.

Another object of the present invention is to turn and hold a patient at ninety degrees on their left side or right side without letting the patient transition or roll into an uncomfortable face down position. No prior art has achieved this goal.

It is another object of this present invention to provide a mechanism to roll a patient that can be applied to a standard bed frame by affixing a motorized footboard that transfers mechanical power to an unmotorized headboard.

It is another object of the invention to provide a compact mechanism for turning a patient that is not connected to a wall, a ceiling or other adjoining structure.

It is yet another object of the invention to provide a patient rolling device that avoids placing the patient in a face down position throughout the entire range of movement of the rolling process.

Another object of the present invention is to provide a patient rolling device with a minimal footprint so it can be placed adjacent to walls, furniture and other structure, without interfering with the patient turning mechanism.

It is yet another object of this invention to provide such a device that is inexpensive to manufacture and maintain while retaining its effectiveness.

Another feature of the present invention is the capability to use a narrow bed because of the lifting character of the parallel roller shafts working in combination with corresponding independent left and right carriages.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE SEVERAL VIEWS OF THE DRAWING

With the above and other related objects in view, the invention exists in the details of construction and combination of parts as will be more fully understood from the following description, when read in conjunction with the accompanying drawings in which.

DETAILED DESCRIPTION OF THE INVENTION

Figure 1:
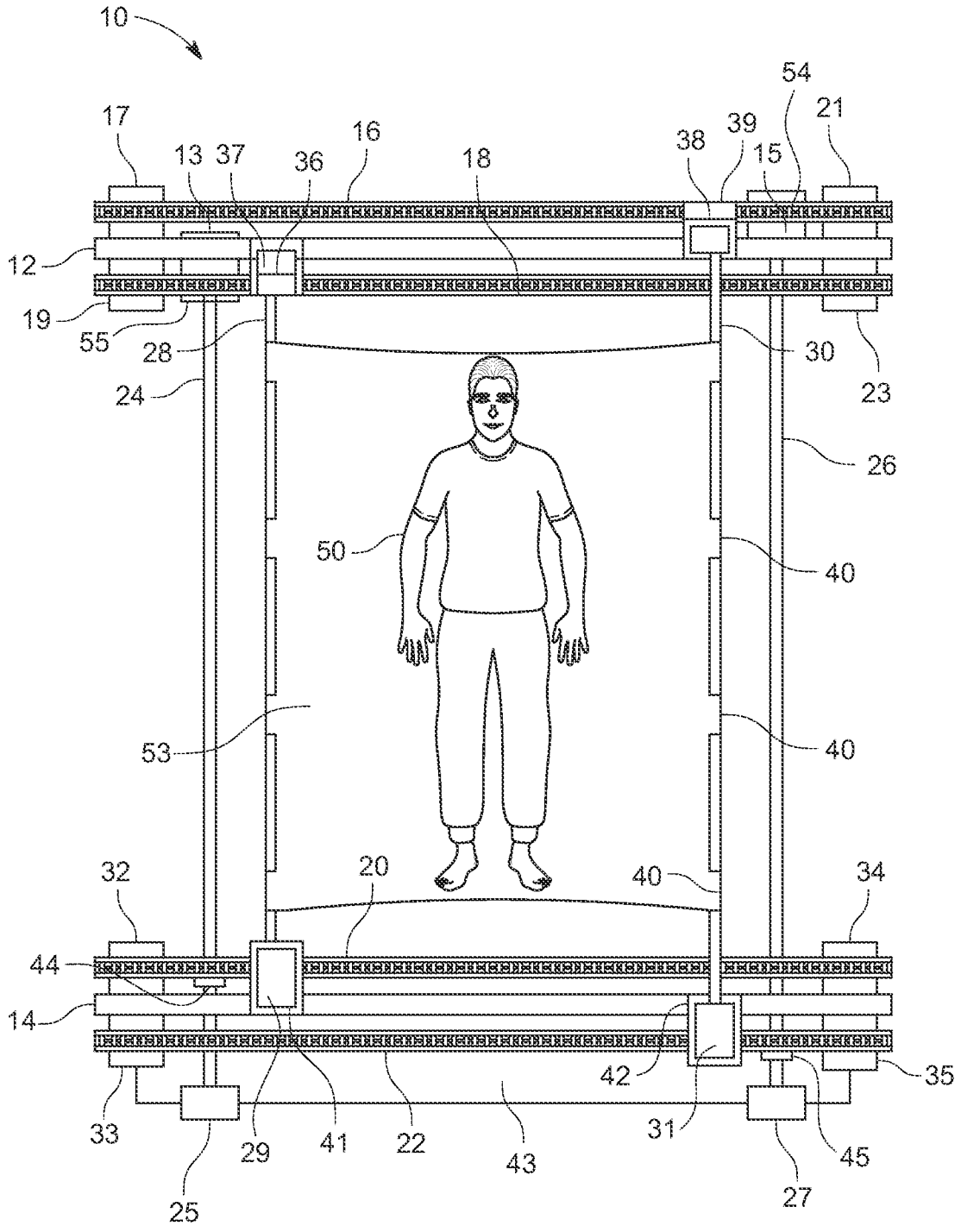
FIG. 1 shows a top plan view of an example of a patient laying on a bed including the rolling bed device.

While this invention may be embodied in many different forms, there are described in detail herein specific embodiments of the invention. This description is exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the rolling bed, the bed, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Bedridden patients with limited mobility risk cutaneous and subcutaneous ulcers. These decubitus ulcers are also commonly known as bedsores, pressure sores or pressure ulcers. Generally, these terms refer to a breakdown of patient tissue where prolonged contact of their body against a supporting surface occurs.

Historically, attendants or nurses have attempted to mitigate the risk of decubitus ulcers by periodically repositioning the patient to prevent long-term contact between a particular portion of skin and the underlying bed surface. For patients that retain mobility, this is not as significant a risk as the patients who are larger, heavier and are unable to reposition by themselves.

Various mechanical devices have been designed to lift rotate and roll patients with varying degrees of success. Many of these devices, by nature of their design, have an unfortunate result of placing a patient in a face down position. This is not beneficial nor comfortable to the patient. Other solutions include ceiling, wall-mounted or bed frame mounted arms to lift, manipulate and roll the patient.

Most of these prior art devices require interaction from a nurse to ensure patient safety and to initiate the process. These devices are intended to assist a nurse in rotating a patient. Whereas, the present device can fully accommodate patient rotation without any direct nurse interaction. By using the current invention, one nurse or technician can monitor the functioning of many different beds and patients using the device, thereby reducing the labor necessary to adequately turn patients to avoid decubitus ulcers.

Referring now to the drawings, where the present invention is generally referred to with numeral 10, it can be observed that it basically includes a headboard 12, a bearing 13, a footboard a 14, a bearing 15, a chain 16, a sprocket 17, a chain 18, a sprocket 19, a chain 20, a sprocket 21, a chain 22, a sprocket 23, a driveshaft 24, a drive motor 25, a driveshaft 26, a drive motors 27, a roller shaft 28, a roller motor 29, a roller shaft 30, a roller motor 31, a sprocket 32, a sprocket 33, a sprocket 34, a sprocket 35, a bearing 36, a carriage 37, a bearing 38, a carriage 39, tabs 40, a carriage 41, a carriage 42, a base 43, a sprocket 44, a sprocket 45, a mattress 46, a tensioner 47, a sprocket 48, a sprocket 49, a patient 50, a wedge 51, a wedge 52, a sheet 53, a sprocket 54, a sprocket 55, a controller 56, a cuff 58, a right arm 60, a cuff 62 and a left arm 64 and other shown and described elements.

Looking at the drawings, it can be seen that the rolling bed includes a headboard 12 affixed to the head of the bed and a footboard 14 affixed to a foot end of the bed. A base 43 is provided to add structure onto which is affixed the drive motor 25 and drive motor 27. The base 43 also supports the footboard 14. A similar structure to the base 43 may also be provided with the headboard 12.

Drive motor 25 is connected to the drive shaft 24. The drive shaft 24 in turn is operationally connected to sprocket 44 on the footboard 14 side and sprocket 55 on the headboard 12 side. Sprocket a 44 is engaged into chain 20 on the footboard 14. Sprocket 55 is engaged into chain 18 on the headboard 12 side. Because the driveshaft 24 is fixed to both sprocket 55 and sprocket 44 the chain 18 and chain 20 move simultaneously in the same direction and at the same rate.

Affixed to chain 20 is carriage 41. Affixed to chain 18 is carriage 37. Because chain 18 and chain 22 move in the same direction and same rate, so do the carriage 37 and carriage 41. The drive motor 25 thereby moves both carriage 37 and carriage 41 together in parallel.

The drive shaft 24 is supported on the headboard 12 and rotates freely about bearing 13. The drive shaft 24 does not move laterally, only rotates about its longitudinal axis to impart rotational force upon sprocket 55 and thereby chain 18, as well as rotate sprocket 44 to move chain 20. The driveshaft 24 always remains perpendicular to the chain 20 and chain 18.

Figure 2:
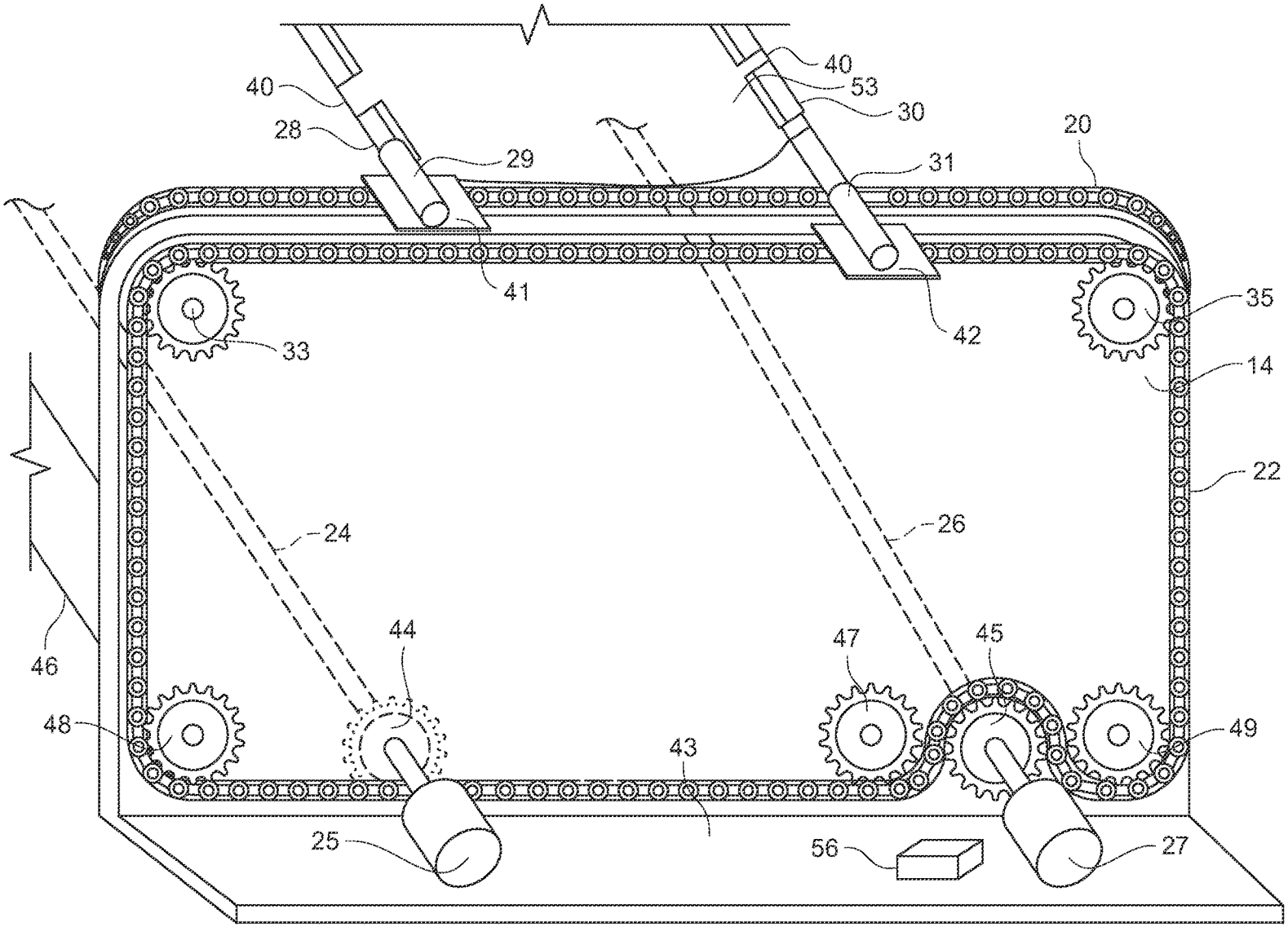
FIG. 2 shows a partial perspective view of the footboard portion of the bed also demonstrating some hidden components in broken lines.

Looking at FIG. 2, the chain 22 is shown in more detail. Sprocket 33, sprocket 35, sprocket 49 and sprocket 48 support the chain 22 and provide a perimeter pathway upon which the carriage 42 travels as the chain 22 is moved by the drive motor 25. A tensioner 47 (also fairly described as an idler sprocket or idler pulley) may also be provided to ensure that sufficient tension is applied to the chain 22 to ensure engagement of sprocket 33, sprocket 35, sprocket 48 and sprocket 49 into the links of the chain 22 without slipping.

Because the chain 20 is continuous and the carriage 41 is affixed to the chain 20, the carriage 41 can travel along with the chain anywhere in the range from about sprocket 48 past sprocket 32 and towards sprocket 35. This gives the carriage 41 and the associated roller shaft 28 a wide range of movement.

Similarly, the carriage 37 can move with chain 18 about corresponding positions bounded by sprocket 55 and sprocket 23 on the upper edge of the headboard 12 that mirror the position of carriage 41 on footboard 14. The headboard 12 on a lower edge facing the mattress 46 has sprockets define the inside bottom left and right corners of the chain 18 on the headboard 12.

The roller shaft 28 is rotationally engaged into bearing 36 on the carriage 37 at one end and at the other and is affixed to roller motor 29 in turn attached to carriage 41. The roller motor 29 imparts a rotational force onto to the roller shaft 28. The sheet 53 is attached to the roller shaft 28 at a series of tabs 40. Because the sheet 53 is attached to the roller shaft 28 the tab's 40, and the roller shaft 24 can rotate under force of the roller motor 29, the sheet 53 can be selectively wound around and unwound from the roller shaft 28.

The drive motor 27 is connected to driveshaft 26. The driveshaft 26 is in turn connected to sprocket 45 and sprocket 54. Sprocket 45 is engaged into chain 22. Sprocket 54 is engaged into chain 16. Because the sprocket 54 and sprocket 45 are both affixed to the driveshaft 26, the chain 18 and chain 22 move together in the same direction and at the same rate.

Carriage 42 is affixed to chain 22. Carriage 39 is affixed to chain 16. Because chain 16 and chain 20 are directly connected through the driveshaft 26, the carriage 39 and carriage 42 move together in the same direction and at the same rate. This ensures that the roller shaft 30 always remains perpendicular to both the headboard 12 in the footboard 14 and the carriages 42 and 39 move in concert.

Roller shaft 30 at one end is rotationally engaged into bearing 38 affixed to carriage 39. The opposite end of roller shaft 30 is engaged into roller motor 31 that is affixed to carriage 42. The roller motor 31 imparts a rotational force onto the roller shaft 30 and the edge of the sheet 53 that is affixed to the roller shaft 30 at a series of tabs 40. This configuration allows the sheet 53 to be selectively spooled around the roller shaft 30 as it rotates. The roller motor 31 can selectively rotate in either direction to spool and unspool the sheet 53 from around the roller shaft 30.

The spooling and unspooling of the sheet independently on either the roller shaft 28 or 30 provides the ability to take up slack or tension in the sheet 53 to apply the appropriate amount of pressure to roll the patient 50. By unspooling at the appropriate point in the roll transition process the patient 50 can be gently guided and controlled to avoid abrupt roll movement of body or arms.

An advantage of having the drive motors 25 and drive motors 27 on the footboard 14 along with the roller motor 31 and roller motor 29 is that electrical power need only be supplied to one end of the bed. It should be appreciated that the headboard 12 and footboard 14 can conceptually be reversed by re-orienting the patient 50. It is not necessary that the motors be at the foot instead of the head. The important concept is that all the motors are at either the head or the foot of the bed. The opposing side then receives rotational power through the roller shafts 28 and 30 that spool the sheet 53 and driveshafts 24 and 26 that, through integral sprocket gears, move the respective chains and the carriages supported and moving thereon.

A controller 56 is also provided near the drive motors 25 and 27 and roller motors 29 and 31. The controller is supplied with electrical power and in turn actuates the drive motors 25 and 27 independently. Likewise the roller motors 29 and 31 are independently controlled by the controller 56. This allows independent and preprogrammed positioning of carriages 41 and 42 as well as selectively and independently rotating the roller shaft 28 and 32 spool and unspool the sheet 53.

An optional manual mode of the controller 56 provides a switch that a nurse or the patient can operate to cause the turning sequence to initiate in either direction on command. This allows a nurse to roll the patient 50 with little more than the flip of a switch.

The controller 56 may be pre-programmed with a timer and set of instructions to move the carriages 41 and 42, as well as controlling the rotation of roller shaft 28 and 30 on a specific schedule. For example, the controller 56 may be programmed to move the patient 50 seamlessly from their right side, back and left side (and vice versa) after a predetermined time period in each position. By routinely rotating the patient 50 the risk of pressure ulcers is mitigated.

Roller shaft 28 rides between chains 18 and 20. Chains 18 and 20 are the chains inside the headboard 12 and footboard 14. Roller shaft 30 rides on chains 16 and 22 that are outside the headboard 12 and footboard 14. This prevents the roller shaft 28 and respective carriages 37 and 41 from colliding with the roller shaft 30 with respective carriages 39 and 42.

FIG. 2 is provided to generally show the configuration of the various components of the rolling bed. The position of carriages 41 and 42 are provided to show the relative position of the components and not where these carriages would be positioned individually or relative to each other in any specific operational mode of the bed. The carriages 41 and 42 can independently move the range of the chain onto which they are affixed, each from a left, upper and right side of the respective headboard and footboard.

Figure 3:
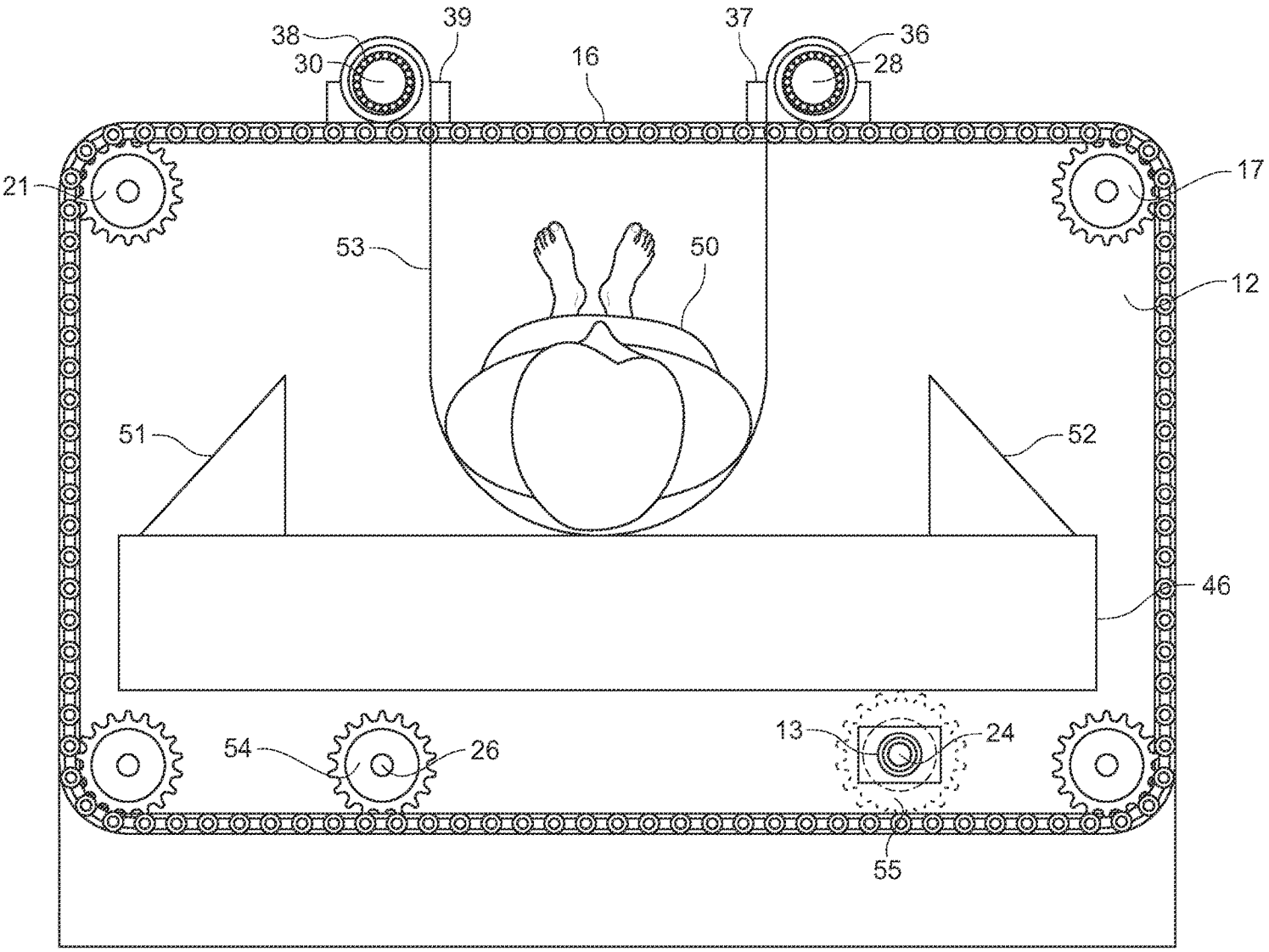
FIG. 3 shows an elevation view of the headboard with the patient in a back position superimposed.

FIG. 3 is provided to show the relative location of the several components of the device from the perspective near the headboard 12. The patient 50 is shown as if the headboard 12 were partially transparent to demonstrate the location of the patient while in a back position relative to wedges 51 and 52. The position of carriages 37 and 39 are not representative of any specific configuration during a particular mode of operation.

FIG. 3 also shows the bearing 13 affixed to headboard 12 within which the drive shaft 24 rotates. The sprocket 55 is affixed to the drive shaft 24 immediately on the patient 50 side of the headboard 12. The sprocket 55 engages into chain 18, both of which are hidden in this view behind the headboard 12. The drive shaft 26 is affixed to sprocket 54 to directly drive the chain 16.

The chain 16 in FIG. 3 may also include a tensioner or idle or wheel such as the tensioner 47 also shown in FIG. 2 to keep tension on the chain and the teeth of the sprockets 19, 55, 54 and 23 engaged into chain 16. The sprockets 23, 19 and 55 generally rotate freely on a bearing associated with each sprocket. Whereas the drive gear, sprocket 54 is powered by the drive shaft 26 to impart a motive force on the chain 16.

Figure 4:
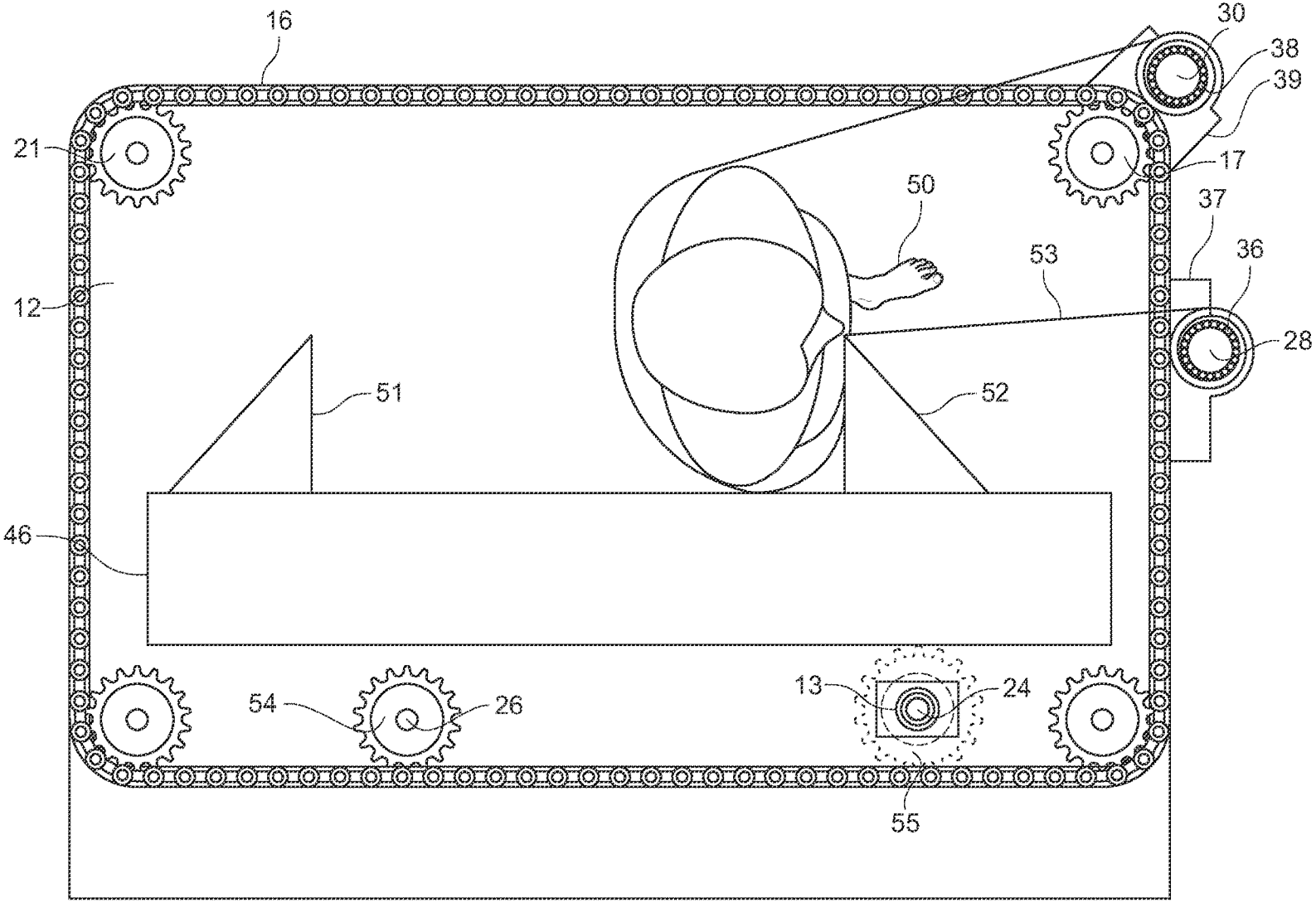
FIG. 4 shows an elevation view of the headboard with the patient in a right position superimposed.

FIG. 4 shows an example of a patient 50 in the process of rolling onto their right side. The carriage 37 is lowered along the edge of the headboard 12 to a position adjacent to the upper corner of the wedge 52. The roller shaft 28 may unwind a portion of the sheet 53 to reduce tension on the right side of the patient 50. Simultaneously, the carriage 34 moves toward the upper opposite corner of the headboard 12 where the roller shaft 30 spools the sheet 53 onto the roller shaft 30 increasing the tension of the sheet 53 on the left and back side of the patient 50. The combination of spooling the sheet 53 onto the roller shaft 30 with the movement of the carriage 39 above the patient 50 causes the patient 50 to gently roll onto their right side.

The wedge 52 is provided both as a guide for the sheet 53 as well as a stop for preventing the patient 50 from rolling beyond their right side and onto their face. The wedge 52 may be adhered to the sheet that covers the mattress 46 by a hook and loop fasteners or other suitable means to position and hold fast of the wedge 52 on the upper surface of the sheet covering the mattress 46. For example, magnets, clips, snaps, straps, tape or friction grip pads can be used to hold the wedges in place.

The extent to which the sheet 53 is coiled around the roller shaft 30 and roller shaft 28 during any transition from back to side is controlled by the controller 56 to supply sufficient, but not too much, pressure onto the patient 50 for a gentle roll in the prescribed direction. If needed, the carriage 39 may remain in a position over the patient 50, such as shown in FIG. 4, to aid the patient maintaining a position with the right side in contract the mattress 46. For some patients, the carriage 39 may return to a position along the left side of the headboard 12 while unspooling the sheet 53 to avoid enclosing the patient 50 in the sheet 53.

FIG. 4 also shows the position of carriage 37 slightly above the upper surface of the mattress 46. By having the carriage 37 not moving the lower than shown approximately as in the position in FIG. 4, the patient's arm can not be trapped and pinched between the carriage 37 and the lateral edge of the mattress 46. There will always remain a space for the patient's arm. This feature may be particularly important if the wedges 51 and 52 are not used.

Figure 5:
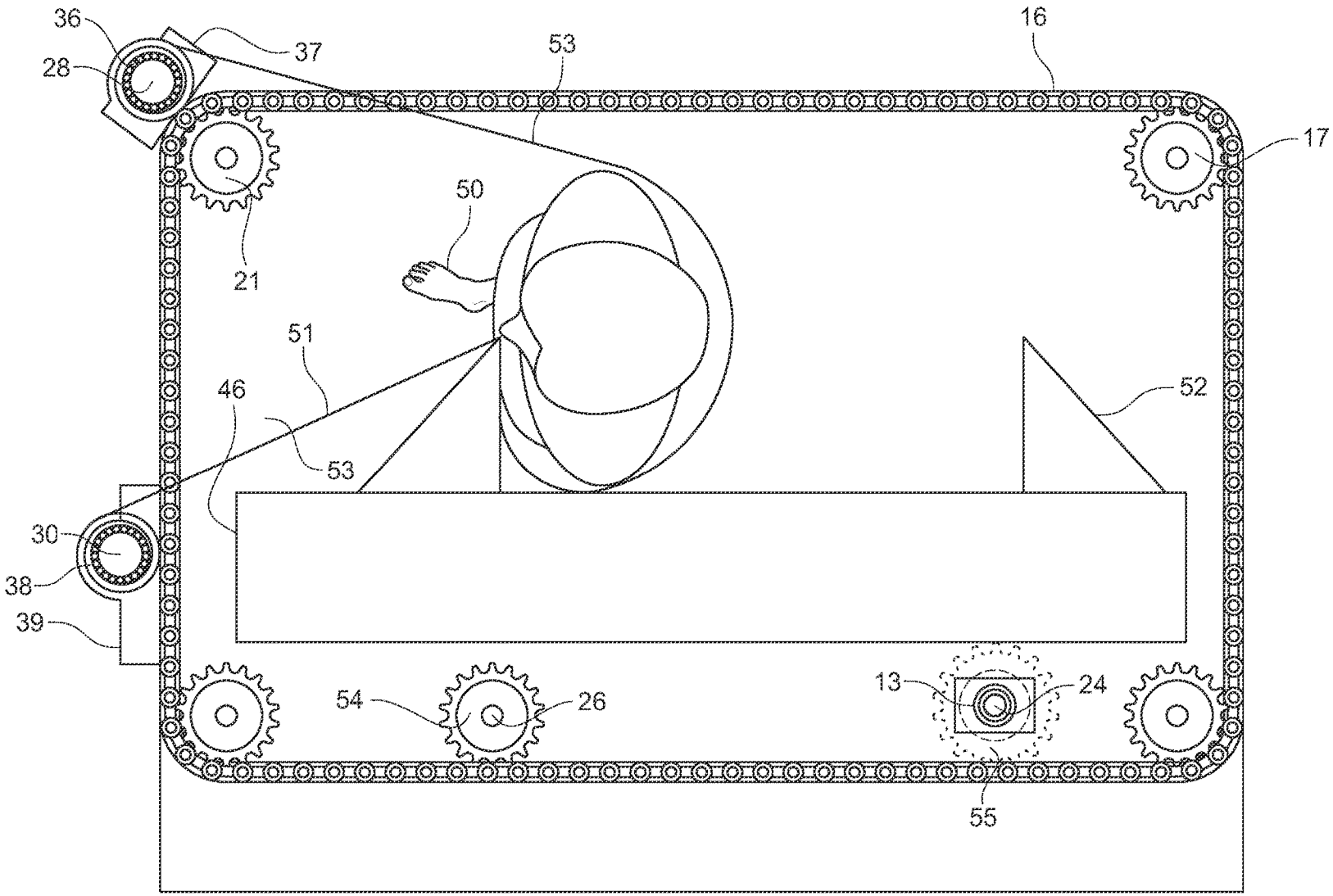
FIG. 5 shows an elevation view of the headboard with the patient in a left position superimposed.

FIG. 5 shows an example of a patient 50 in the process of rolling onto their left side from the perspective of the headboard 12. The carriage 39 on the left side of the patient is generally in a position adjacent to the wedge 51. The carriage 37 moves from a position on the right side of the patient, over the patient to the opposite upper corner of the headboard 12. This may also require the roller shaft 30 unspooling some of the sheet 53 while the roller shaft 28 spools up some of the sheet 53 to apply gentle pressure to the back and right side of the patient 50. The wedge 51 is affixed to the sheet covering the mattress 46 and prevents the patient 50 from rolling onto their face or off the edge of the mattress 46.

Once the patient is comfortably positioned on their left side, carriage 37 can then begin to return to the right side of the patient 50 while the roller shaft 28 unspools some of the sheet 53. If the patient 50 has a tendency to fall again on their back with the carriage 37 removed to their right, the carriage 37 may remain in a position substantially above the patient 50. This may require some spooling of the sheet 53 about the roller shaft 28.

It should be appreciated that the terms left and right used herein may be interchanged and remain within the inventive concept. Similarly, the head and foot designations of the patient 50 may be inverted as appropriate for the position of the patient 50 and location of the rolling bed device in the room.

FIG. 5 also shows an alternate position of the carriage 39 at a position lower than the upper surface of the mattress 46. This is in contrast to the carriage 37 in the example described in FIG. 4, above. As for the position in FIG. 5, the carriage 39 may be lowered to this position when the patient is to be manually removed by a caregiver from the bed. This can remove the carriage 39 from being in the way when sliding the patient off of the bed. Generally, the carriage 39 would only be in this position lower than the upper surface of the mattress 46 for a short time while the patient 50 is being transferred.

Although chains 16, 18, 20 and 22 are shown in the drawings, other means of moving the carriages 39, 37, 42 and 41 may be equally effective. For example, these chains may be substituted for flexible belts, cables, chains or tracks on which the several carriages may ride. The important concept is that the carriages 37 and 41 move in concert and together remain perpendicular to the footboard 14. Likewise, the carriages 39 and 42 move in concert and also together remain perpendicular to the footboard 14.

An advantage of the present device is that the headboard 12 and footboard 14 can be attached to any standard bed frame. This greatly reduces of the cost of having an entirely proprietary bed frame and mattress combination. In at least one version of the device a single size headboard and footboard can be used with any width of mattress. Alternatively, the headboard 12 and footboard 14 can be provided in several different width configurations to fit onto a bed frame with a particular size of mattress.

The wedges 51 and 52 may be made of a soft material, such as a foam core with a cover. The wedges 51 and 52 may be repositioned on the sheet covering the mattress 46 to adapt to different size patients 50. For example, a larger patient 50 may have a wider space between the wedges 51 and 52. Where a slender patient 52 or a child may have the wedges 51 and 52 separated by a narrower space.

The wedges 51 and 52 should be positioned on the sheet covering the mattress 46 so that the patient 50 does not over-roll onto their face and front side. Instead, for safety and comfort, the wedges 51 and 52 should be positioned so that the patient does not roll beyond the prescribed left side and right side.

The combination of carriage 37, roller shaft 28 and carriage 41 move entirely independently of, yet remain parallel to, the combination comprising carriage 39 roller shaft 30 carriage 42. The roller shaft 30 and 28 also spool and unspool the sheet 53 completely independently of each other.

The drive shaft 24 that connects the chain 18 by sprocket 55 with the chain 20 by sprocket 44 remains in a fixed position. Similarly, the drive shaft 26 that connects the chain 16 by sprocket 54 with the chain 22 by the sprocket 45 remains in a fixed position. Both the drive shaft 24 and drive shaft 26 rotate about their respective longitudinal axis to cause the respective chains to reposition the carriages.

In one version of the device the controller 56 is remotely controllable by a wired or wireless network. The controller 56 can show the operational status and positioning of the patient 50 based on the location of the several carriages. A processing device remote to the rolling bed may provide signals to operate the several motors of the rolling bed. In this way the actions of the bed, and therefore the rolling position of the patient, can be controlled via the network from a remote device.

This can allow remote monitoring of a plurality of rolling beds. For example, this can be useful if a group of patients each have their own rolling bed on a floor of a hospital. In this way a single nurse's station can ensure the appropriate rolling and safety of that group of patients by controlling and monitoring from the nurse's station and requiring only one nurse.

The drive shafts 24 and 26 are generally constructed of a rigid and tortion-resistant material. Metal alloys, polymers, carbon fiber and other such tubes or solid bars have been found to be effective. The roller shafts 28 and 30 may also be made from similar materials as the driveshafts 24 and 26 to resist torsion deflection.

The sheet 53 may be fabricated from a flexible and durable material, such as woven or nonwoven fabrics. The sheet 53 also plays a role in the mitigation of decubitus ulcers by being made of a material that does not aggravate these skin conditions. The tension of the sheet 53 under the patient 50 may also be adjusted to mitigate conditions contributing to pressure sores. An effective material has been shown to be woven fabric cotton blends.

The sheet 53 is preferably removable from the respective roller shafts 28 and 30. This allows for replacement and removal for laundering. A series of clips, hook and loop fasteners, snaps or other attachment means at the tabs 40 may facilitate easily attachment and removal of the sheet 53 to the respective roller shafts 28 and 30. The tabs 40 may be substitutes with a continuous connection means along the respective roller shafts and should also be removable.

Figure 6:
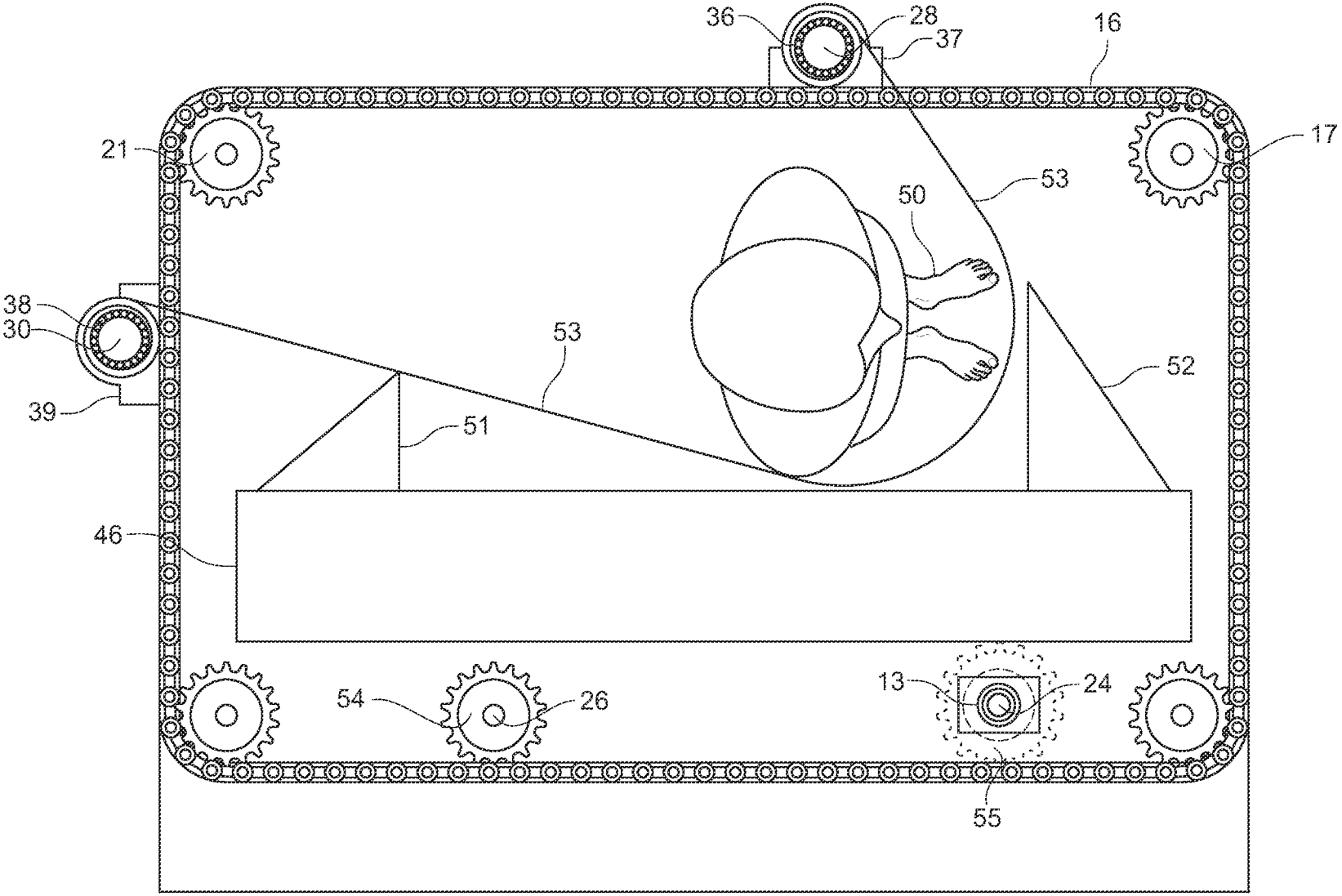
FIG. 6 shows an elevation view of the patient rolling from a right side to their back.

FIG. 6 is an example of the patient 50 transferring from a right side position to their back against the upper surface of the mattress 46. The carriage 39 moves to the patient's left while the carriage 37 moves up and over the patient to allow a gentle role onto their back. In FIG. 6, the pressure off the patient's back has just been released and the patient is about to be gently nudged by the sheet 52 and roller 37 on a front side to roll again onto their back.

Figure 7:
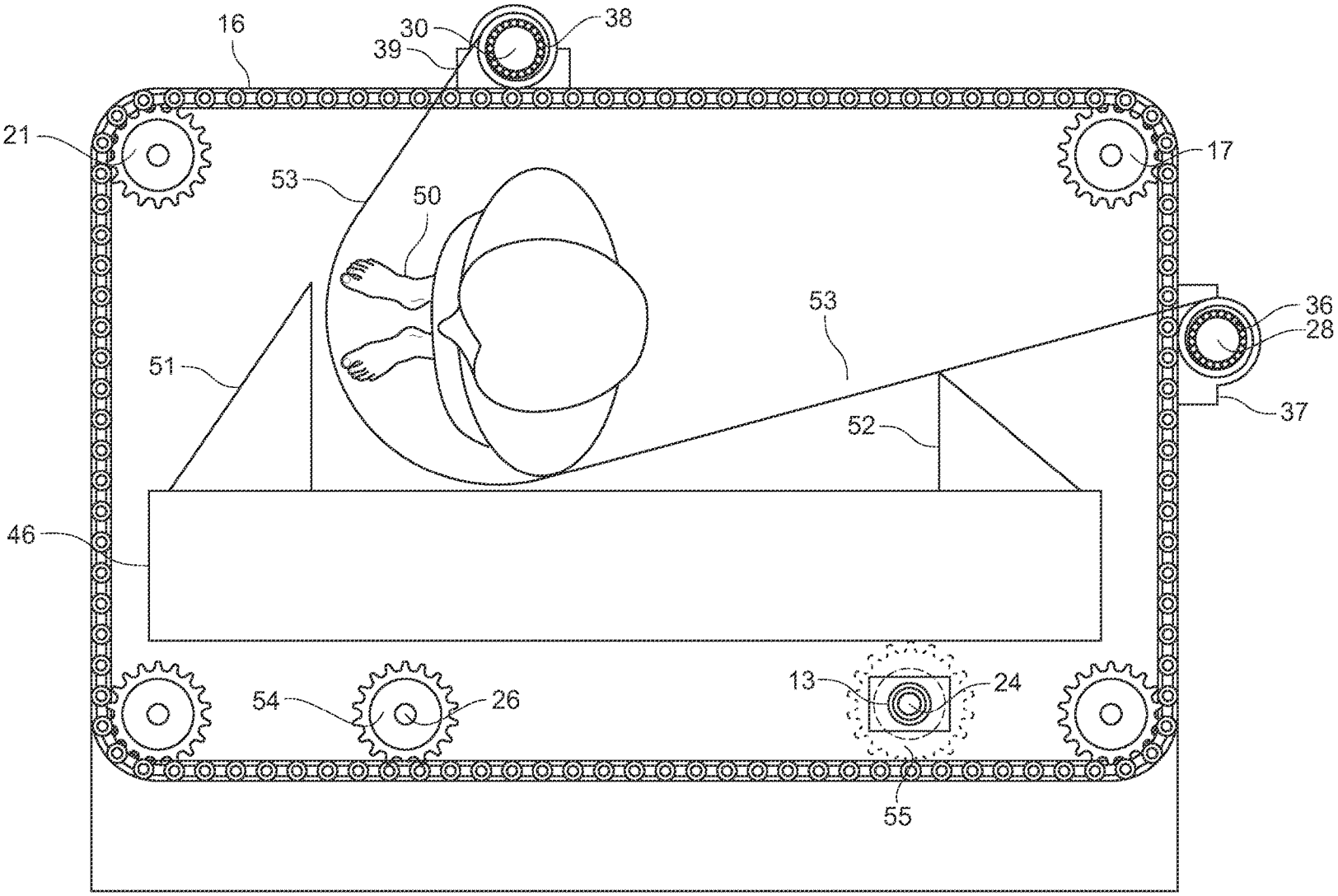
FIG. 7 shows an elevation view of the patient rolling from a left side to their back.

FIG. 7 is a demonstration of the patient in the process from resting on a left side to transitioning to having their back against the upper surface of the mattress 46. The carriage 37 that had held the sheet 53 against the patient's back moves toward the patient's right side relieving that back pressure. At the same time, carriage 39 applies a gentle pressure to the front side of the patient allowing the patient 52 gently roll onto their back.

Figure 8:
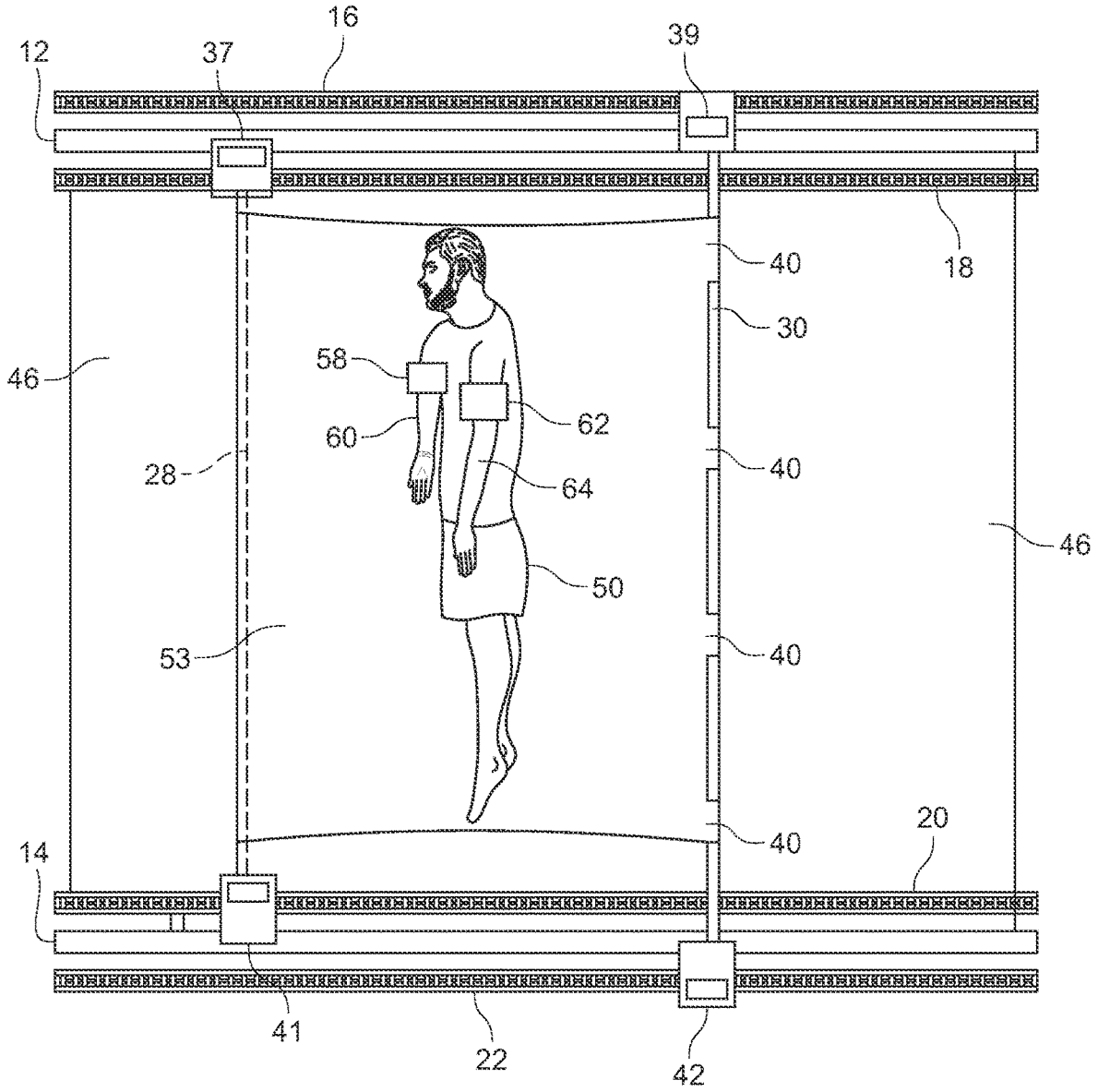
FIG. 8 shows a plan view of the patient wearing cuffs instead of using wedges.

FIG. 8 shows an alternative to the wedges 51 and 52. The patient is outfitted with a cuff 58 on their right arm 60 and a cuff 62 on their left arm 64. As the patient 50 is rolled from the back position to the right side, the cuff 58, right arm 60 is kept on a front side of the patient thereby preventing the patient from rolling over onto their face. Similarly, the patient on their back when rolling to their left side will keep their left arm 64 on a front side of the patient preventing that patient from rolling their face.

These cuffs 58 and 62 perform a very similar function as the wedges 51 and 52 in that the patient is automatically prevented from rolling onto the very uncomfortable position on their front side or face. This can simplify the device by not requiring large wedges and the features that attach the wedges to the sheet covering the mattress 46.

The cuffs 58 and 62 may take the form of an inflatable armband. The deflated cuffs 58 and 62 would be placed over the patient's respective arm 60 and 64 and then inflated to keep the cuffs 58 and 62 onto the arms. Preferably, the cuffs 58 and 62 would be positioned gently on the patient's upper arm between the elbow and shoulder.

The cuffs 58 and 62 may also take the form of a padded armband that is wrapped over the upper arm of the patient 50. For example, these cuffs 58 and 62 may be plush, soft covered foam or other filled material with a fastener to encircle the arm, such as a hook and loop fasteners or, snaps or buttons. The cuffs 58 and 62 are preferably soft and nonirritating to the skin both on the inside of the cuff that contacts the patient's arm and the exterior of the cuff that the patient's chest may rest against when on their side.

An important version of the present invention can be fairly described as an automated rolling bed comprising, among other features, a controller, a headboard and a footboard. Affixed to the footboard 14 is a first motor 25 operably connected to a first carriage assembly 41 that moves on a first track means 20 along and upper periphery of the footboard 14. The first motor 25 has a first drive shaft 24 that operably connects to a second carriage assembly 37 that moves on a second track means 18 along an upper periphery of the headboard 12. Affixed to the footboard 14 is a second motor 27 operably connected to a third carriage assembly 42 that moves on a third track means 22 along the upper periphery of the footboard 14. The second motor has a second drive shaft 26 that operably connects to a fourth carriage assembly 39 that moves on a fourth track means 16 along the upper periphery of the headboard 12. The first carriage assembly 41 has a third motor 29 operably connected with a first roller shaft 28 to a bearing 36 on the second carriage assembly 37. The third carriage assembly 42 as a fourth motor 31 operably connected with a second roller shaft 32 and a bearing 38 on the fourth carriage assembly 39. The first carriage assembly 41 and second carriage assembly 37 move together and at a common rate so that the first roller shaft 28 always remains parallel to the first drive shaft 24. The third carriage assembly 42 and fourth carriage assembly 39 move together at a common rate so that the second roller shaft 30 always remains parallel to the second drive shaft 26. Sheet 11 along a first edge is affixed to the first roller shaft 28 and along an opposing edge is affixed to the second roller shaft 30. The third motor 29 rotates the first roller shaft 28 to selectively spool and unspool the first edge of the sheet 11. The fourth motor 31 rotates the second roller shaft 32 selectively spool and unspool the second edge of the sheet 11. In a face up orientation of a patient 50 is positioned on a middle segment of the sheet 11 with the first roller shaft 28 positioned on a first side of the patient 50 and the second roller shaft 30 positioned on a second side of the patient 50. To roll the patient 50 from a face up orientation to a first side orientation the first motor 25 moves together both the first carriage assembly 41 and the second carriage assembly 37 to read position of the first roller shaft 28 from the first side of the patient 52 over the patient 50 in the third motor 29 rotates the first roller shaft 28 to spool the sheet 11 onto the first roller shaft 28 thereby rolling the patient 50 to the first side orientation and then the first motor 25 returns the first roller shaft 28 to the first side of the patient 50 and the third motor unspools the sheet 11 from the first roller shaft 28. Then to roll the patient 50 from the first side orientation to the face up orientation a second motor 27 moves together both the third carriage assembly 42 and the fourth carriage assembly 39 to read position of the second roller shaft 30 from the second side of the patient 50 over the patient 50 thereby pulling the second edge of the sheet and rolling the patient 50 into the face up orientation. Then to roll the patient 50 from the face up orientation to a second side orientation the second motor 27 moves together both the third carriage assembly 42 and the fourth carriage assembly 39 to repositioned the second roller shaft 30 from the second side of the patient 52 over the patient 50 in the fourth motor 31 rotates the second roller shaft 30 to spool the sheet 11 onto the second roller shaft 30 thereby rolling the patient 50 to the second side orientation and then the second motor 27 returns the second roller shaft 32 the second side of the patient 50 in the fourth motor unspools the sheet 11 from the second roller shaft 30. Then to roll the patient 50 from the second side orientation to the face up orientation the first motor 25 moves together both the first carriage assembly 41 and the second carriage assembly 37 to repositioned the first roller shaft 28 from the first side of the patient 50 over the patient 50 thereby pulling the first edge of the sheet and rolling the patient 50 onto the face up orientation. Optionally, the rolling bed further includes a first wedge 51 affixed to a top surface of a sheet covering the mattress 46 on a first side of a patient 50 to prevent the patient 50 from rolling beyond the first side position and a second wedge 52 is affixed to a sheet covering the top side of the mattress 46 on a second side of the patient 50 to prevent the patient from rolling beyond the second side position. Also optionally and as an alternative to the wedges 50 and 51, a cuff may be placed on the patient's 50 right arm and left arm between the elbow and shoulder to prevent the patient 50 from rolling over onto their face.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

I claim:

1. An automated rolling bed comprising: a controller, a headboard and a footboard;

a first motor (25) is affixed to the footboard (14), the first motor (25) is operably connected to a first carriage assembly (41), wherein the first carriage assembly (41) is configured on a first track means (20) along an upper periphery of the footboard (14);

the first motor (25) comprising a first drive shaft (24) operably connected to a second carriage assembly (37), wherein the third carriage assembly is configured to move on a second track means (18) along an upper periphery of the headboard (12);

affixed to the footboard (14) is a second motor (27) operably connected to a third carriage assembly (42) that moves on a third track means (22) along the upper periphery of the footboard (14);

the second motor (27) comprising a second drive shaft (26) operably connected to a fourth carriage assembly (39), wherein the fourth carriage assembly is configure to move on a fourth track means (16) along the upper periphery of the headboard (12);

the first carriage assembly (41) comprising a third motor (29) operably connected with a first roller shaft (28) to a bearing (36) on the second carriage assembly (37);

the third carriage assembly (42) comprising a fourth motor (31) operably connected with a second roller shaft (30) to a bearing (38) on the fourth carriage assembly (39);

the first carriage assembly (41) and second carriage assembly (37) are configured to move together and at a common rate such that the first roller shaft (28) is configured to remain parallel to the first drive shaft (24);

the third carriage assembly (42) and the fourth carriage assembly (39) are configured to move together at a common rate such that the second roller shaft (30) is configured to remain parallel to the second drive shaft (26);

a sheet (11) comprised of first and second edges is affixed to the first roller shaft (28) along the first edge and is affixed to the second roller shaft (30) along the second edge;

the third motor (29) is configured to rotate the first roller shaft (28) such that the first roller shaft selectively spools and unspools the first edge of the sheet (11);

the fourth motor (31) is configured to rotate the second roller shaft (30) such that the first roller shaft selectively spools and unspools the second edge of the sheet (11);

a patient (50) is positioned on a middle segment of the sheet (11) in a face up orientation such that the first roller shaft (28) is positioned on a first side of the patient (50) and the second roller shaft (30) is positioned on a second side of the patient (50);

the first motor (25) is configured to move the first and second carriage assemblies such that the first roller shaft (28) is repositioned from the first side of the patient (50) to the second side of the patient (50); wherein the third motor (29) is configured to rotate the first roller shaft (28) to spool the sheet (11) onto the first roller shaft (28) thereby rolling the patient (50) from the face up orientation to a first side orientation; wherein the first motor (25) is configured to return the first roller shaft (28) to the first side of the patient (50) and the third motor is configured to unspool the sheet (11) from the first roller shaft (28);

the second motor (27) is configured to move the third and fourth carriage assemblies such that the second roller shaft (30) is repositioned from the second side of the patient (50) over the patient (50) thereby pulling the second edge of the sheet and rolling the patient (50) from the first side orientation into the face up orientation;

the second motor (27) is configured to move the third and fourth carriage assemblies such that the second roller shaft (30) is repositioned from the second side of the patient (50) to the first side of the patient (50) wherein the fourth motor (31) is configured to rotate the second roller shaft (30) to spool the sheet (11) onto the second roller shaft (30) thereby rolling the patient (50) from a face up orientation to a second side orientation, wherein the second motor (27) is configured to return the second roller shaft (30) to the second side of the patient (50) and the fourth motor is configured to unspool the sheet (11) from the second roller shaft (30);

the first motor (25) is configured to move the first and second carriage assemblies such that the first roller shaft (28) is repositioned from the first side of the patient (50) over the patient (50) thereby pulling the first edge of the sheet and rolling the patient (50) from the second side orientation into the face up orientation.

2. The rolling bed of claim 1 comprising a first wedge (51) that is affixed to a sheet covering a top side of a mattress (46) on a first side of the patient (50) to prevent the patient (50) from rolling beyond the first side position and a second wedge (52) that is affixed to the sheet covering the top side of the mattress (46) on a second side of the patient (50) to prevent the patient from rolling beyond the second side position.

3. The rolling bed of claim 1 comprising a first cuff (58) that is placed on the patient's right upper arm preventing the patient from rolling over their right arm and onto their front side when rolling onto their right side; and a second cuff (62) that is placed on the patient's left upper arm preventing the patient from rolling over their left arm and onto their front side when rolling onto their left side.

* * * * *